US006955308B2

(12) United States Patent
Segrest et al.

(10) Patent No.: US 6,955,308 B2
(45) Date of Patent: Oct. 18, 2005

(54) PROCESS OF SELECTIVELY REMOVING LAYERS OF A THERMAL BARRIER COATING SYSTEM

(75) Inventors: Janna Lannell Segrest, Simpsonville, SC (US); David Vincent Bucci, Simpsonville, SC (US); Mark Roger Brown, Greenville, SC (US); Joseph Anthony DeBarro, Greer, SC (US)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 10/604,024

(22) Filed: Jun. 23, 2003

(65) Prior Publication Data

US 2004/0256504 A1 Dec. 23, 2004

(51) Int. Cl.[7] ..... B02C 19/12

(52) U.S. Cl. ..... 241/1; 29/889.1; 427/454; 427/456

(58) Field of Search ..... 241/1, 301; 134/32, 134/34, 38; 29/889.1, 889.7, 402.18; 427/454, 427/455, 456

(56) References Cited

U.S. PATENT DOCUMENTS

| | | | | |
|---|---|---|---|---|
| 5,073,433 | A | 12/1991 | Taylor | 428/134 |
| RE35,611 | E | 9/1997 | McComas et al. | 134/32 |
| 5,743,013 | A | 4/1998 | Taylor et al. | 29/889.7 |
| 5,830,586 | A | 11/1998 | Gray et al. | 428/621 |
| 5,897,921 | A | 4/1999 | Borom et al. | 427/454 |
| 5,942,045 | A * | 8/1999 | Raghavan et al. | 134/34 |
| 5,989,343 | A | 11/1999 | Borom et al. | 118/308 |
| 6,004,620 | A | 12/1999 | Camm | 427/142 |
| 6,180,184 | B1 | 1/2001 | Gray et al. | 427/453 |
| 6,432,487 | B1 | 8/2002 | Graham et al. | 427/454 |
| 6,660,102 | B2 * | 12/2003 | Jeutter et al. | 134/28 |
| 6,729,940 | B2 * | 5/2004 | Farmer et al. | 451/35 |
| 2002/0086117 | A1 | 7/2002 | Graham et al. | 427/446 |
| 2003/0027013 | A1 | 2/2003 | Schaeffer et al. | 428/632 |

* cited by examiner

*Primary Examiner*—Mark Rosenbaum
(74) *Attorney, Agent, or Firm*—Ernest Cusick; Gary M. Hartman; Domenica N. S. Hartman

(57) ABSTRACT

A process of selectively removing layers of a thermal barrier coating system from a surface of a component. A thermal barrier coating system of interest comprises an inner metallic bond coat layer, an outer metallic bond coat layer that is less dense than the inner metallic bond coat layer, and a ceramic topcoat having vertical cracks therethrough. The process involves directing a jet of liquid at the component to simultaneously remove the topcoat and the outer metallic bond coat layer without removing the inner metallic bond coat layer.

22 Claims, 2 Drawing Sheets

PROCESS OF SELECTIVELY REMOVING LAYERS OF A THERMAL BARRIER COATING SYSTEM

BACKGROUND OF INVENTION

1. Field of the Invention

The present invention relates to protective coatings for components exposed to high temperatures, such as components of a gas turbine engine. More particularly, this invention is directed to a process for removing a ceramic coating and an underlying metallic coating that lie on a second metallic coating on the surface of a component without removing or damaging the second metallic coating.

2. Description of the Related Art

Components located in the hot gas path of a gas turbine engine (e.g., turbine buckets, nozzles and shrouds) are often thermally insulated with a ceramic layer in order to reduce their service temperatures, which allows the engine to operate more efficiently at higher temperatures. These coatings, often referred to as thermal barrier coatings (TBC), must have low thermal conductivity, strongly adhere to the article, and remain adherent throughout many heating and cooling cycles. Coating systems capable of satisfying these requirements may include a metallic bond coat that adheres the thermal-insulating ceramic layer to the component, forming what is termed a TBC system. Metal oxides, such as zirconia ($ZrO_2$) partially or fully stabilized by yttria ($Y_2O_3$), magnesia (MgO) or other oxides, have been widely employed as the material for the thermal-insulating ceramic layer. The ceramic layer, or topcoat, is typically deposited by air plasma spraying (APS), low pressure plasma spraying (LPPS), or a physical vapor deposition (PVD) technique, such as electron beam physical vapor deposition (EBPVD) which yields a strain-tolerant columnar grain structure. Bond coats are typically formed of an oxidation-resistant diffusion coating such as a diffusion aluminide or platinum aluminide, or an oxidation-resistant alloy such as MCrAlY (where M is iron, cobalt and/or nickel). MCrAlY-type bond coats are termed overlay coatings, and are deposited by physical or chemical vapor deposition techniques or by thermal spraying, e.g., APS, LPPS and high velocity oxy-fuel (HVOF), which entails deposition of the bond coat from a metal powder.

Though significant advances have been made with coating materials and processes for producing both the environmentally-resistant bond coat and the thermal-insulating ceramic topcoat, circumstances can arise where one or more of the TBC layers must be replaced. For example, removal may be necessitated by damage during engine operation, or during component manufacturing to address such problems as coating defects, handling damage, and the need to repeat noncoating-related manufacturing operations. Abrasive techniques for removing thermal barrier coatings generally involve grit blasting, vapor honing and glass bead peening, each of which is a slow, labor-intensive process that erodes the ceramic layer and bond coat, as well as the substrate surface beneath the coating. Nonabrasive processes for removing ceramic coatings include autoclaving and high pressure waterjet, the latter of which is reported in commonly-assigned U.S. Pat. Nos. 5,558,922, 6,099,655, 6,544,346 and 6,210,488, as well as U.S. Pat. Nos. 5,167,721 and Re. 35,611 to McComas et al. The waterjet technique disclosed by McComas et al. is described as being capable of removing plasma sprayed and sintered coatings whose cohesive strength is significantly less than that of the substrate on which the coating is deposited. In reference to a ceramic coating adhered to a substrate with a bond coat, McComas et al. report that the waterjet pressure can be adjusted to remove the ceramic coating without bond coat damage, or remove the bond coat without substrate damage if pressures of not more than 60,000 psi (about 4000 bar) are used.

Notwithstanding the above, TBC and bond coats can be difficult to remove and repair. If specific layers of a TBC system cannot be selectively removed from a component without damaging the other layers or the component substrate surface, it may be necessary to scrap the component. This situation is exasperated with TBC systems that make use of coating materials that are stronger than those used in conventional TBC systems, or that comprise more than two coating layers of similar materials, such as where only one of multiple bond coat layers requires removal. One example of such a coating system is a TBC system developed by the assignee of the present invention to have a relatively high-strength, dense vertically cracked (DVC) plasma-sprayed ceramic topcoat and a metallic bond coat having at least two layers. According to commonly-assigned with U.S. Pat. No. 5,817,372, such a bond coat has an inner layer (nearer the substrate) that is denser than a second layer on which the topcoat is deposited.

SUMMARY OF INVENTION

The present invention provides a process of selectively removing layers of a thermal barrier coating system from a surface of a component. A particular thermal barrier coating system of interest to the invention comprises an inner metallic bond coat layer, an outer metallic bond coat layer that is less dense than the inner metallic bond coat layer, and a ceramic topcoat having vertical cracks therethrough. A particular example of such a coating system has an inner metallic bond coat layer deposited by a high-velocity oxy-fuel process, and an outer metallic bond coat layer and ceramic topcoat deposited by plasma spraying. The process of this invention generally involves directing a jet of liquid (e.g., water) at the component to simultaneously remove the topcoat and the outer metallic bond coat layer without removing the inner metallic bond coat layer. For this purpose, the jet is preferably emitted from a nozzle at a pressure of at least 40,000 psi (about 2800 bar) and at an angle of about 30 to about 90 degrees to the surface of the component.

In view of the above, the present invention enables the reclaiming and repair of gas turbine engine components on which a multilayer thermal barrier coating system has been deposited, and from which multiple outer layers are to be removed while leaving at least one layer of the coating system intact. In this manner, the service life of the component can be extended by avoiding replacement of its entire thermal barrier coating system, since removal of the inner bond coat can reduce the wall thickness of the component as a result of interdiffusion between the bond coat and component surface.

The process is particularly adapted to processing components with relatively complex geometries. For this purpose, the outline of the component is established and stored in computer memory, from which a computer program is developed that controls a robotic arm or CNC machine to which the jet nozzle is mounted during the removal process. Depending on the type of coating system and the configuration of the component, additional process parameters that are preferably controlled include the number of passes of the jet, the speed and distance that the jet traverses the component surface, the distance between the nozzle and component surface, and rotation of individual jet streams.

Other objects and advantages of this invention will be better appreciated from the following detailed description.

DETAILED DESCRIPTION

Figure 1:
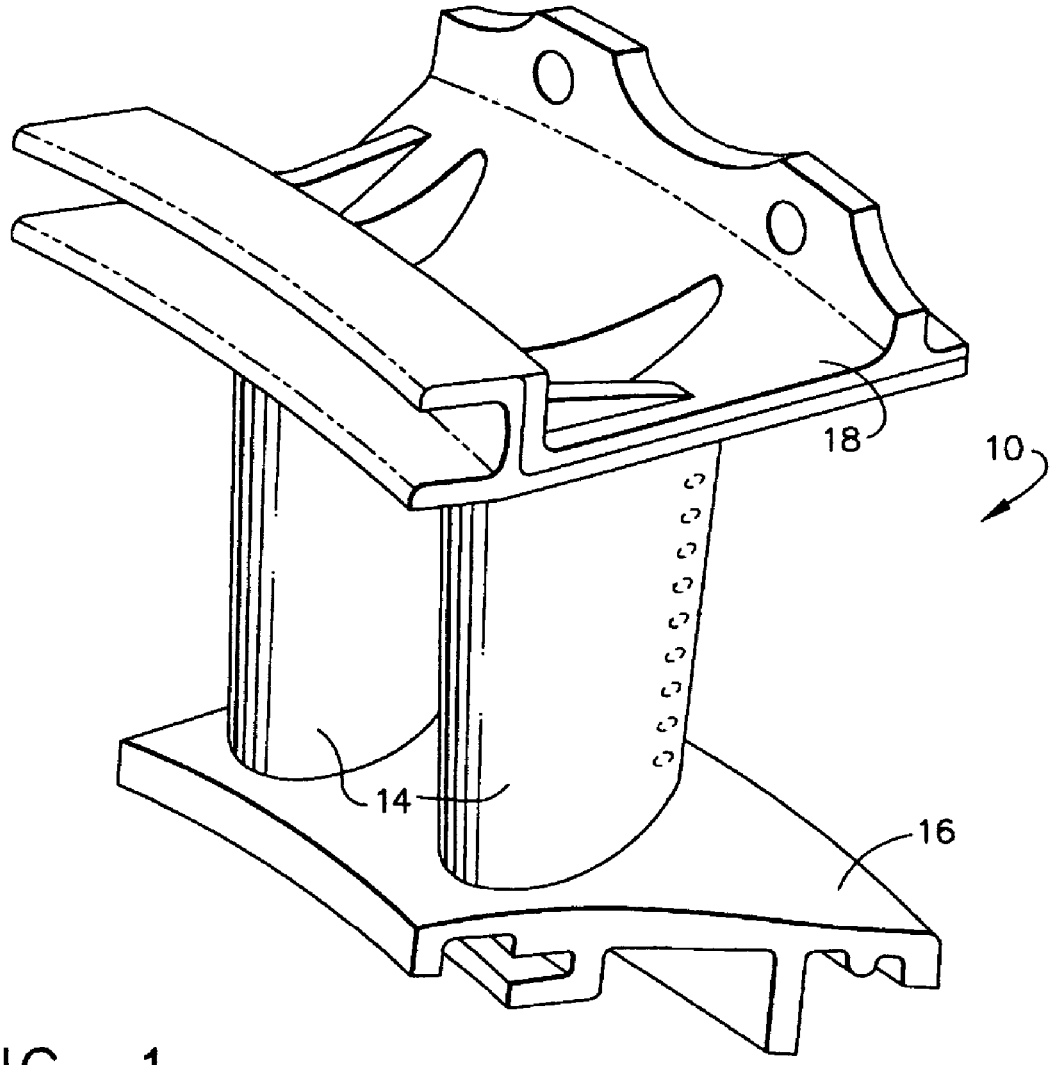
FIG. 1 shows a nozzle section of a type used in the turbine section of a gas turbine engine.
Figure 2:
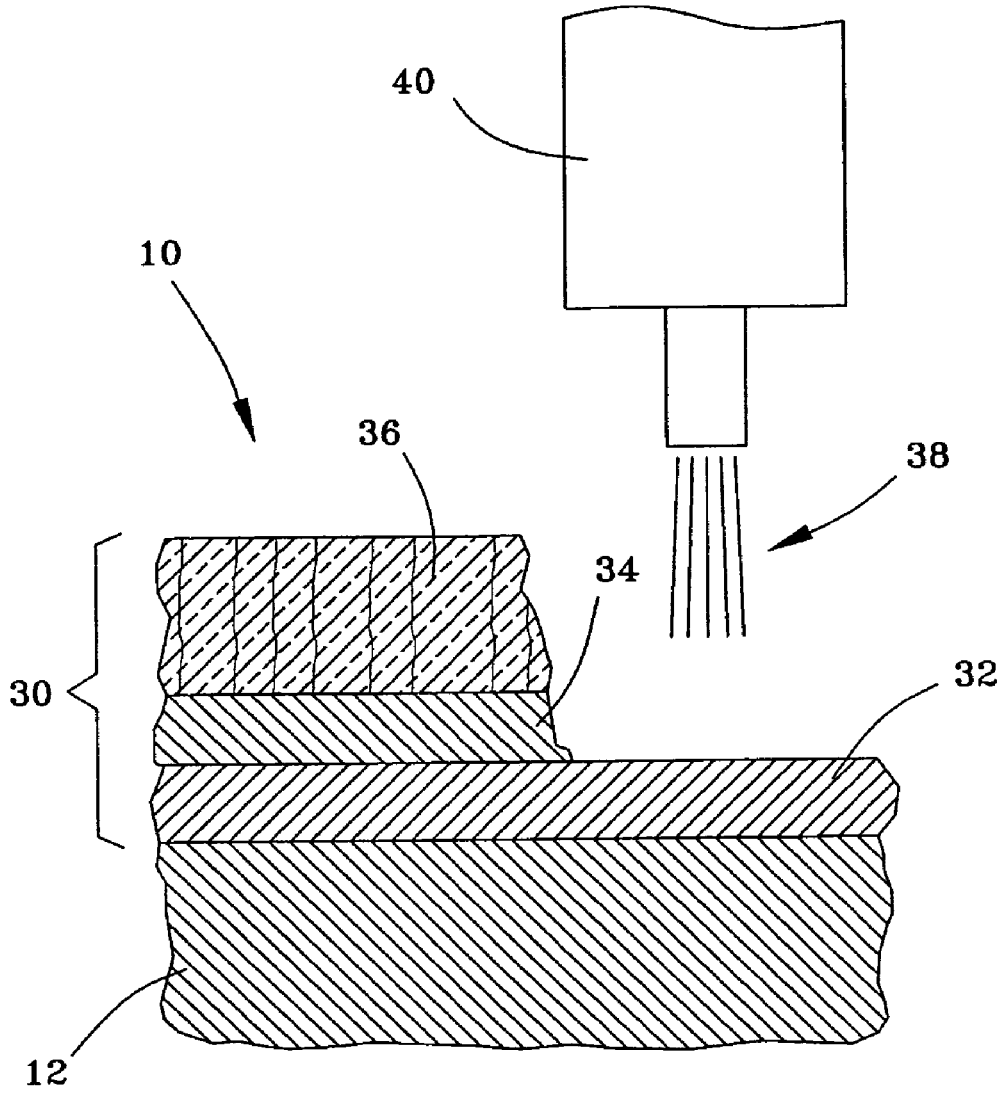
FIG. 2 represents a cross-section through a portion of the nozzle section, and shows a thermal barrier coating system having a ceramic topcoat and two bond coat layers, of which the ceramic topcoat and the outer bond coat layer are being removed with a waterjet in accordance with this invention.

FIG. 1 depicts a gas turbine engine nozzle section 10 of a type known in the art, and FIG. 2 represents a cross-sectional view through a substrate region 12 of the nozzle section 10, from which a thermal barrier coating (TBC) system 30 is being removed. The nozzle section 10, represented as comprising a pair of airfoils 14 mounted between inner and outer bands 16 and 18, may be formed of an iron, nickel or cobalt-base superalloy, though other high temperature materials could foreseeably be used. The TBC system 30 serves to minimize the service temperature of the nozzle section 10, particularly the surfaces of the airfoils 14. For this purpose, the coating system 30 comprises a ceramic topcoat 36 bonded to the surface of the nozzle section 10 with a metallic bond coat, which as discussed in more detail below is formed by a pair of bond coat layers 32 and 34.

FIG. 2 represents the topcoat 36 as having been deposited by a plasma spraying technique, such as air plasma spraying (APS) or low pressure plasma spraying (LPPS). A preferred material for the ceramic topcoat 36 is an yttria-stabilized zirconia (YSZ) containing about 8 weight percent yttria, though other ceramic materials or porous metallic coatings could be used, including yttria, partially stabilized zirconia, or zirconia stabilized by other oxides, such as magnesia (MgO), ceria ($CeO_2$), scandia ($Sc_2O_3$), etc. According to a preferred aspect of the invention, the topcoat 36 is plasma sprayed under conditions disclosed in commonly-assigned U.S. Pat. No. 6,180,184 to Gray et al. The topcoat 36 is preferably dense (e.g., greater than 90% of theoretical density), has a tensile strength of at least 4000 psi (about 280 bar), and has numerous vertical cracks through its thickness to enhance the strain tolerance of the topcoat 30. The vertical microcracks enable the topcoat 36 to expand with the underlying bond coat layers 32 and 34 and substrate 12 without causing damaging stresses that lead to spallation, as discussed in U.S. Pat. Nos. 5,073,433 and 5,520,516, and elsewhere. The topcoat 36 may have a tensile strength of about 6000 psi (about 410 bar) and even higher (e.g., about 12,000 psi (about 800 bar)), which is significantly stronger than conventional porous TBC coatings, whose tensile strengths are typically not higher than about 2500 psi (about 170 bar). However, topcoats 36 with relatively low tensile strengths (e.g., about 150 psi (about 10 bar)) are also within the scope of this invention. A suitable thickness for the ceramic topcoat 36 is about 0.010 to about 0.020 inch (about 0.25 to about 0.50 mm), though lesser and greater thicknesses are foreseeable.

The bond coat formed by the bond coat layers 32 and 34 must be oxidation-resistant to protect the underlying substrate 12 from oxidation and to enable the plasma-sprayed topcoat 36 to tenaciously adhere to the substrate 12. In order to inhibit oxidation of the substrate 12, the bond coat must also be sufficiently dense to inhibit the diffusion of oxygen and other oxidizing agents to the substrate 12. Because the topcoat 36 is deposited by plasma spraying, the outer bond coat 34 must have a sufficiently rough surface to mechanically interlock with the topcoat 36. Furthermore, the outer bond coat 34 preferably develops an oxide scale (not shown) when exposed to elevated temperatures, providing a surface that promotes adhesion of the topcoat 36. For this purpose, at least the outer bond coat layer 34, and preferably both bond coat layers 32 and 34, contain alumina- and/or chromia-formers, i.e., aluminum, chromium and their alloys and intermetallics. Preferred bond coat materials include MCrAl and MCrAlY, where M is iron, cobalt and/or nickel. However, the present invention is applicable to other multilayer coating systems that have a primary layer overcoated with a more porous and/or less adhesive or cohesive secondary layer.

In combination, the bond coat layers 32 and 34 provide each of the above characteristics as a result the bond coat materials used and the manner in which the bond coat layers 32 and 34 are deposited. In a particular example, the bond coat layers 32 and 34 are deposited by thermal spraying techniques, with the inner bond coat layer 32 being formed by spraying a relatively finer powder such that the layer 32 is relatively dense (e.g., greater than 95% of theoretical density), while the outer bond coat layer 34 is deposited by thermal spraying a relatively coarser powder so as to have a sufficiently rough outer surface that will adhere the plasma-sprayed topcoat 36. As such, the inner bond coat layer 32 provides a very dense barrier to oxidation, while the outer coat layer 34 has a desirable surface roughness to promote mechanical interlocking with the subsequently-applied topcoat 36. Finally, both bond coat layers 32 and 34 are preferably formed of the same composition, e.g., the same MCrAlY composition.

With the coating system 30 described above, refurbishment of the coating system 30 to extend the life of the component (nozzle section 10) may necessitate removing the ceramic topcoat 36 and the outer bond coat layer 34, while the inner bond coat layer 32 is permitted to remain. The ability to leave the inner bond coat layer 32 intact is desirable, since removal of this layer 32 would also result in the removal of some of the substrate 12 beneath the layer 32 because of interdiffusion that inherently occurs between the layer 32 and substrate 12. According to a preferred aspect of this invention, both the topcoat 36 and the outer bond coat layer 34 can be removed from the surface of the inner bond coat layer 32 with a non-abrasive liquid jet 38, represented in FIG. 2 as being emitted from a nozzle 40 oriented approximately normal to the surfaces of the coating layers 32, 34 and 36 and the component substrate 12. The non-abrasive jet 38 is able to remove the topcoat 36 and outer bond coat layer 34 substantially simultaneously without removing or damaging the inner bond coat layer 32, even when the inner bond coat layer 32 has the same composition (though differing in density and/or microstructure) as the outer bond coat layer 34. At most, the jet 38 has a surface roughening effect on the inner bond coat layer 32 that can promote the adhesion of the outer bond coat layer 34 deposited to replace the one removed with the jet 38. The jet 38 employed by the invention is termed non-abrasive because it does not contain any abrasive media of the type often used in waterjet processes. While various fluids could be used, water is preferred as being environmentally safe and because it will not chemically affect the coating materials or the nozzle section 10. A suitable process employs water pressurized of at least 40,000 psi (about 2800 bar) to as much as about 60,000 psi (about 4100 bar), such as about 45,000 to about 55,000 psi (about 3100 to about 3800 bar), with a preferred pressure being about 50,000 psi (about 3500 bar).

In the process of removing the ceramic topcoat 36 and outer bond coat layer 34, the jet nozzle 40 is connected to a suitable waterjet apparatus and delivers the jet 38 toward the surface of the nozzle section 10. A suitable orientation of the jet 38 to the surface of the nozzle section 10 being stripped of coating is believed to be at an angle of about thirty to ninety degrees, a particularly suitable range being about forty-five to ninety degrees from the surface, and a preferred orientation being about ninety degrees to the surface. A suitable standoff distance (the distance between the jet nozzle 40 and the surface of the topcoat 36) is about 0.1 to about 2 inches (about 2.5 to about 50 mm), though greater and lesser distances are foreseeable. The jet 38 may comprise a single jet or, more preferably, multiple individual jets that rotate about the axis of the jet 38 as a result of the nozzle 40 being equipped with a rotating head, examples of which are commercially available from Progressive Technology, Inc. Another controlled parameter of the waterjet process is the speed at which the jet 38 traverses the component surface with each pass. A suitable traversal rate for the jet 38 is believed to be about 2.5 to about 10 inches per minute (about 6 to about 25 cm/minute). Movement of the jet 38 relative to the component surface is preferably continuous. Employing the above parameters, the topcoat 36 and outer bond coat layer 34 can be simultaneously removed in a single pass, though it is foreseeable that multiple passes may be required.

In order to suitably maintain each of the above parameters on a component having a complex geometry, such as the nozzle section 10 depicted in FIG. 1, the jet nozzle 40 can be mounted to a robotic arm, CNC or other computer-controlled equipment whose movement is preprogrammed, based on geometrically data acquired and stored for the particular component being processed. For this purpose, the outline of the nozzle section 10 is determined and stored in computer memory. With this data, the robotic arm can be controlled so that the jet nozzle 40 maintains the desired orientation and distance to the component surface, as well as the speed at which the jet 38 traverses the component surface. A suitable robotic waterjet system for this purpose is commercially available from Progressive Technology, Inc.

A non-abrasive water jet 38 as described above, operated at a pressure of about 50,000 psi (about 3500 bar) and oriented about ninety degrees to the surface a gas turbine engine component coated with a TBC as described herein, was shown to successfully remove a dense, high-strength YSZ topcoat and an outer bond coat layer (deposited by APS) from the surface of a denser inner bond coat layer (deposited by HVOF) formed of the same material as the outer layer (MCrAlY), without damaging the inner layer. While not wishing to be held to any particular theory, this capability was attributed to the greater density and cohesion/adhesion strength of the HVOF layer. As such, at the specified pressure, the jet 38 was able to remove a ceramic topcoat that is significantly stronger and denser than conventional TBC topcoats, as well as an underlying bond coat layer, without damaging a second bond coat layer of the same material directly beneath the removed bond coat layer.

While the invention has been described in terms of a preferred embodiment, it is apparent that other forms could be adopted by one skilled in the art. Therefore, the scope of the invention is to be limited only by the following claims.

What is claimed is:

1. A process comprising the steps of:

forming a coating system on a surface of a component, the coating system being formed by depositing an inner metallic coating layer, depositing an outer metallic coating layer on the inner metallic coating layer so that the outer metallic coating layer has the same composition as the inner metallic coating layer but is less dense than the inner metallic coating layer, and then depositing a ceramic topcoat on the outer metallic coating layer; and directing a jet of liquid at the component, the outer metallic coating layer being formed to be sufficiently less dense than the inner metallic coating layer such that the ceramic topcoat and the outer metallic coating layer are simultaneously removed by the jet without removing the inner metallic coating layer.

2. A process according to claim 1, wherein the inner and outer metallic coating layers have different microstructures.

3. A process according to claim 1, wherein the jet does not contain any abrasive media and is emitted from a nozzle at a pressure of at least 2800 bar.

4. A process according to claim 3, wherein the jet is emitted from the nozzle at an angle of about 30 to about 90 degrees to the surface of the component.

5. A process according to claim 3, wherein the pressure of the jet is about 3500 bar and the jet is emitted from the nozzle at an angle of about ninety degrees to the surface of the component.

6. A process according to claim 1, wherein the jet is directed at the component with an apparatus that substantially maintains the angle of the jet to the surface of the component.

7. A process according to claim 1, wherein after the ceramic topcoat and the outer metallic coating layer are removed, the process further comprises depositing a replacement outer metallic coating layer on the inner metallic coating layer and then a replacement ceramic topcoat on the replacement outer metallic coating layer.

8. A process according to claim 7, wherein the jet roughens the surface of the inner metallic coating layer and thereby promotes adhesion of the replacement outer metallic coating layer to the inner metallic coating layer.

9. A process according to claim 1, further comprising the step of depositing the inner metallic coating layer by a high-velocity oxy-fuel process.

10. A process according to claim 1, further comprising the step of depositing the outer metallic coating layer by a plasma spray process.

11. A process according to claim 1, wherein the compositions of the inner and outer metallic coating layers are MCrAlY, where M is selected from the group consisting of iron, cobalt, nickel, and mixtures thereof.

12. A process according to claim 1, further comprising the step of depositing the ceramic topcoat by a plasma spray process.

13. A process according to claim 12, wherein the ceramic topcoat has a tensile strength of at least about 280 bar.

14. A process according to claim 1, wherein the component is a component of a gas turbine engine.

15. A process comprising the steps of:

forming a thermal barrier coating system on a surface of a gas turbine engine component, the coating system being formed by depositing an inner metallic coating layer, depositing an outer metallic coating layer on the inner metallic coating layer so that the outer metallic coating layer has the same composition as the inner metallic coating layer but is less dense than the inner metallic coating layer, and then depositing a ceramic topcoat on the outer metallic coating layer; and directing a non-abrasive jet of liquid at the component, the outer metallic bond coat layer being formed to be sufficiently less dense than the inner metallic bond coat layer such that the topcoat and the outer metallic bond coat layer are simultaneously removed by the jet without removing the inner metallic bond coat layer, the jet being emitted from a nozzle at a pressure of at least 3100 bar and at an angle of about 45 to about 90 degrees to the surface of the component, the jet being directed at the component with an apparatus that substantially maintains the angle of the jet to the surface of the component.

16. A process according to claim 15, wherein the liquid is water.

17. A process according to claim 15, wherein the pressure of the jet is about 3100 to about 3800 bar.

18. A process according to claim 15, wherein the pressure of the jet is about 3500 bar and the jet is emitted from the nozzle at an angle of about ninety degrees to the surface of the component.

19. A process according to claim 15, wherein the inner and outer metallic bond coat layers have the same composition formed of MCrAlY, where M is selected from the group consisting of iron, cobalt, nickel and mixtures thereof.

20. A process according to claim 15, wherein the ceramic topcoat has a tensile strength of about 410 bar to about 800 bar.

21. A process according to claim 15, wherein the jet roughens the surface of the inner metallic bond coat layer and the process further comprises depositing a replacement outer metallic bond coat layer on the inner metallic bond coat layer and then a replacement ceramic topcoat on the replacement outer metallic bond coat layer.

22. A process according to claim 15, wherein the component is a gas turbine engine component.

* * * * *